US011499256B2

(12) United States Patent
Demange et al.

(10) Patent No.: US 11,499,256 B2
(45) Date of Patent: Nov. 15, 2022

(54) ELLIPTICAL NEEDLELOOM HAVING A SEALED CASING AND A THROUGH GUIDING POT

(71) Applicant: ANDRITZ ASSELIN-THIBEAU, Elbeuf (FR)

(72) Inventors: Frédéric Demange, Montville (FR); Eric Potdevin, Barneville-sur-Seine (FR); Jean-Christophe Laune, La Londe (FR)

(73) Assignee: ANDRITZ ASSELIN-THIBEAU, Elbeuf (FR)

( * ) Notice: Subject to any disclaimer, the term of this patent is extended or adjusted under 35 U.S.C. 154(b) by 0 days.

(21) Appl. No.: 17/237,442

(22) Filed: Apr. 22, 2021

(65) Prior Publication Data

US 2021/0332513 A1 Oct. 28, 2021

(30) Foreign Application Priority Data

Apr. 23, 2020 (FR) ..... 20 04058

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 5/02
(Continued)

(56) References Cited

U.S. PATENT DOCUMENTS 3,849,845 A * 11/1974 Obenaus ..... D04H 18/02 28/107
5,548,881 A * 8/1996 Ludwig ..... D04H 18/02 28/114

(Continued)

FOREIGN PATENT DOCUMENTS

EP 1736587 A1 12/2006
FR 2800396 A1 5/2001

(Continued)

OTHER PUBLICATIONS

INPI Search Report dated Jan. 12, 2021 in related application No. FR 2004058.

*Primary Examiner* — Amy Vanatta
(74) *Attorney, Agent, or Firm* — Renner, Kenner, Greive, Bobak, Taylor & Weber

(57) ABSTRACT

A needling machine to consolidate a fleece. The machine includes one or more needle plates having an array of needles; one or more columns coupled to the needle plates; and driving means configured to impart an elliptical to and fro motion to each needle plate so that the needles pass first in one direction, then the other, over the fleece passing before it in the machine. The machine further comprising a sealed housing enclosing part of each column and driving means; and one or more guide pots within the sealed housing. Each driving means including a longitudinal driving means imparting to each column a straight to and fro motion. Each needle plate oscillates in relation to each respective column. The driving means further comprise transverse driving means imparting to a point on each needle plate a to and fro motion essentially parallel to the machine direction.

10 Claims, 8 Drawing Sheets

(58) Field of Classification Search
USPC ..... 28/114, 107, 115
See application file for complete search history.

(56) References Cited

U.S. PATENT DOCUMENTS

| | | | | | |
|---|---|---|---|---|---|
| 5,822,834 | A * | 10/1998 | Jourde | D04H 18/02 | 28/107 |
| 5,873,152 | A * | 2/1999 | Jourde | D04H 18/02 | 74/44 |
| 6,000,112 | A * | 12/1999 | Ollinger | D04H 18/02 | 28/107 |
| 6,266,856 | B1 * | 7/2001 | Fehrer | D04H 18/02 | 28/107 |
| 6,305,058 | B1 * | 10/2001 | Fehrer | D04H 18/02 | 28/107 |
| 6,389,665 | B1 * | 5/2002 | Fuchs | D04H 18/02 | 28/107 |
| 6,785,940 | B1 * | 9/2004 | Muller | D04H 18/00 | 28/107 |
| 7,107,658 | B2 * | 9/2006 | Muller | D04H 18/00 | 28/114 |
| 2006/0288549 | A1 * | 12/2006 | Jean | D04H 18/02 | 28/107 |
| 2007/0006432 | A1 * | 1/2007 | Noel | D04H 18/02 | 28/107 |
| 2012/0167361 | A1 * | 7/2012 | Reutter | D04H 18/02 | 28/107 |

FOREIGN PATENT DOCUMENTS

| | | | |
|---|---|---|---|
| FR | 2862988 | A1 | 6/2005 |
| WO | 9621764 | A1 | 7/1996 |

* cited by examiner

[Fig. 1]
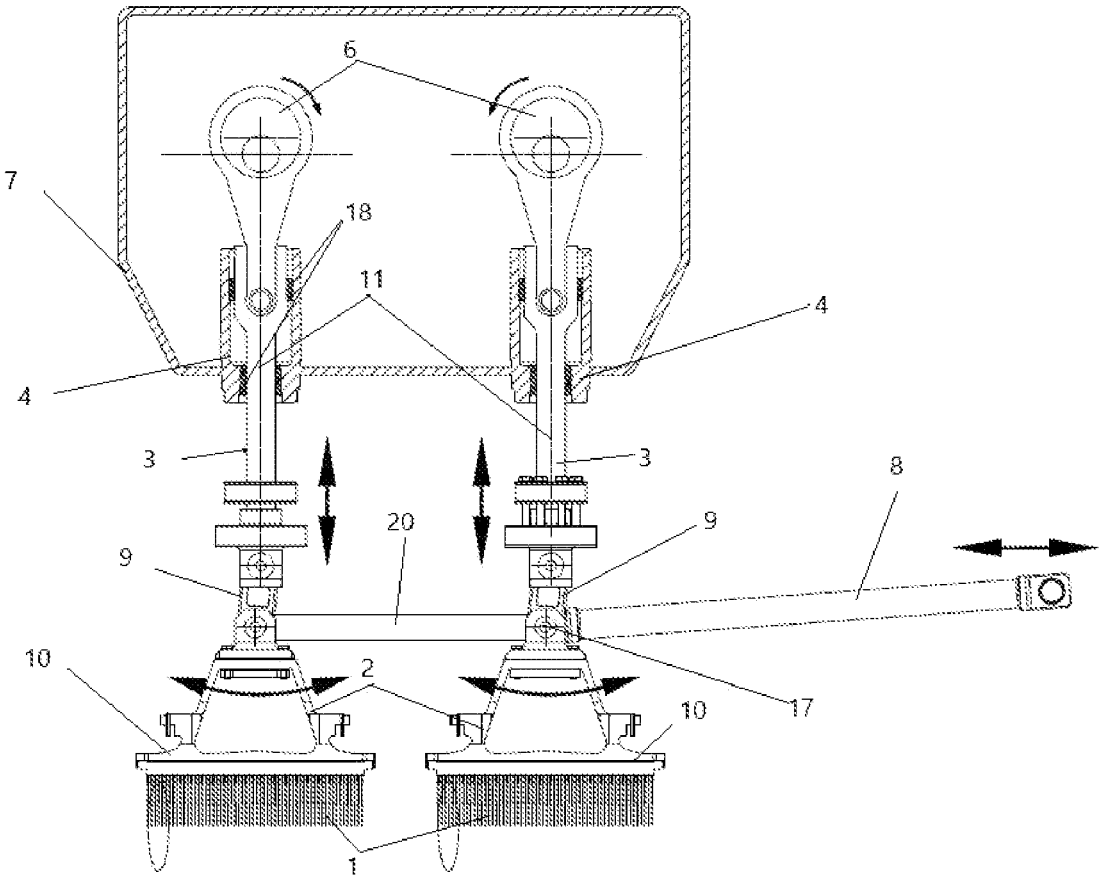

[Fig. 2]
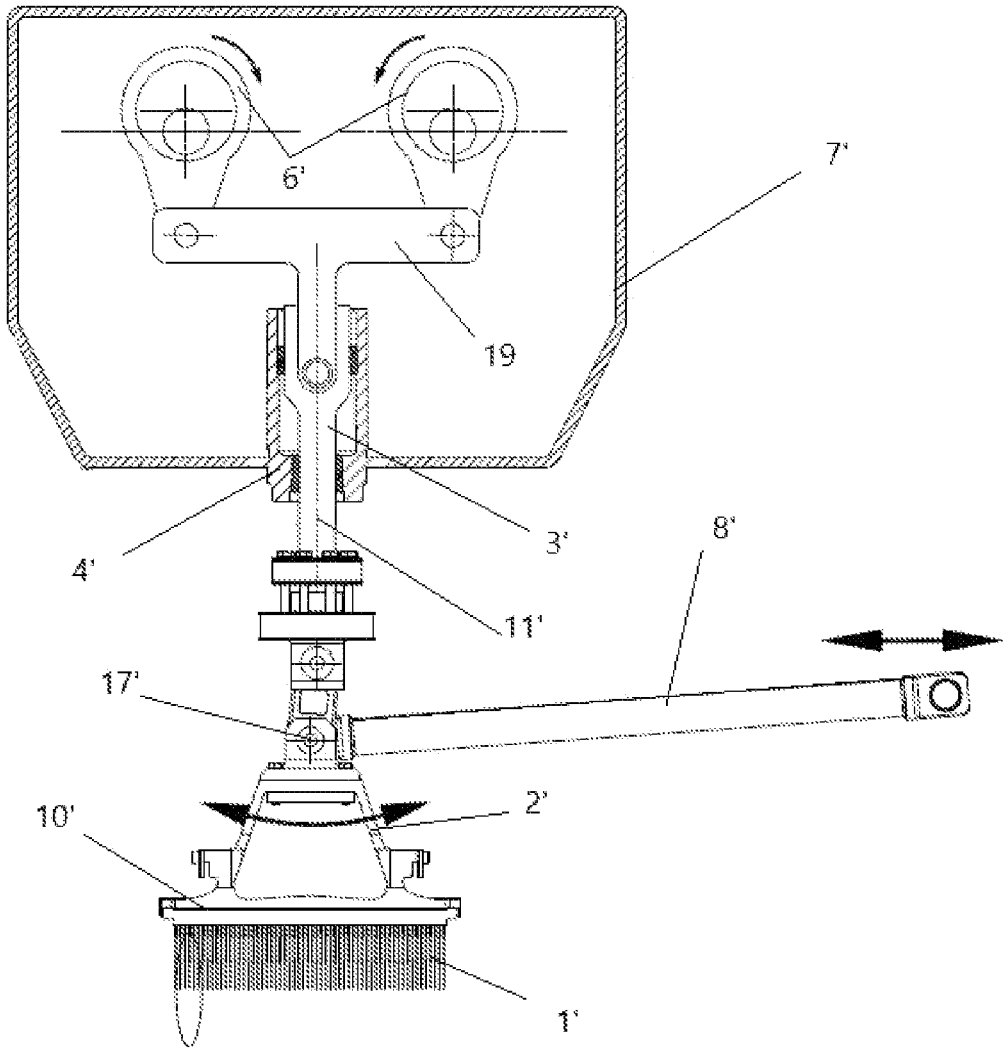

[Fig. 3]
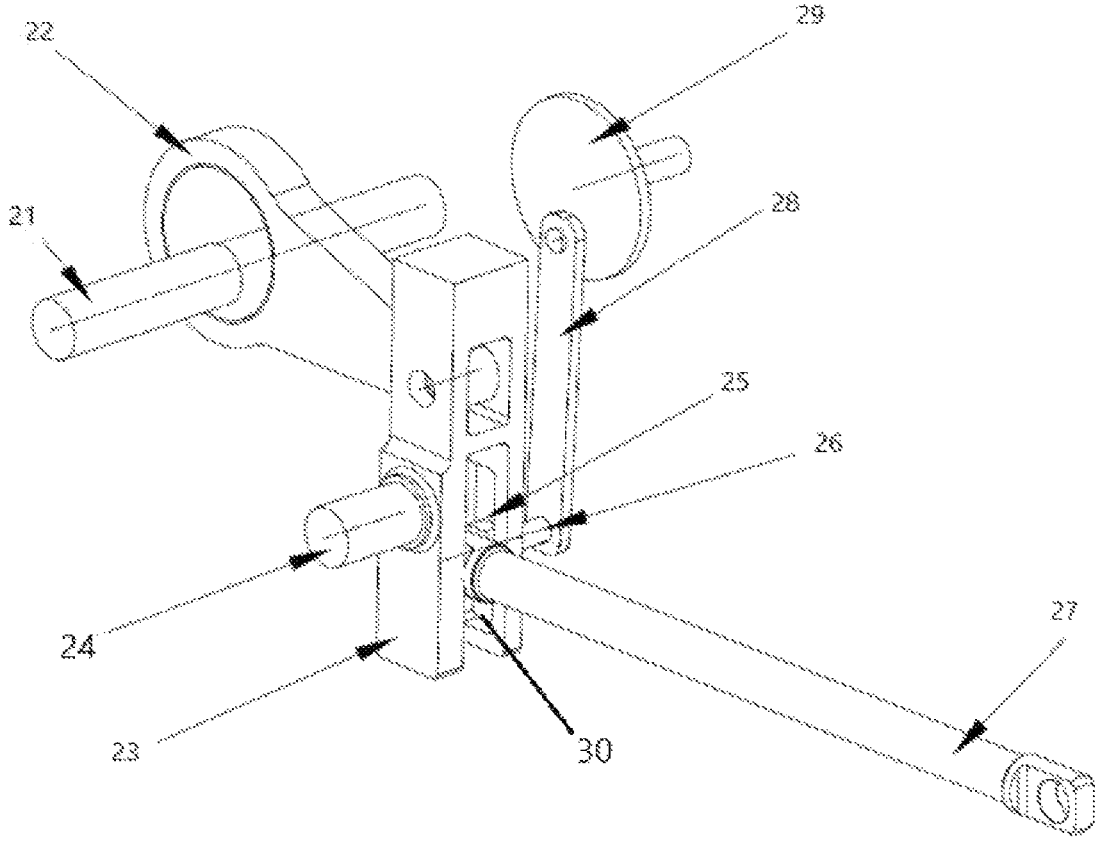

[Fig. 3A]
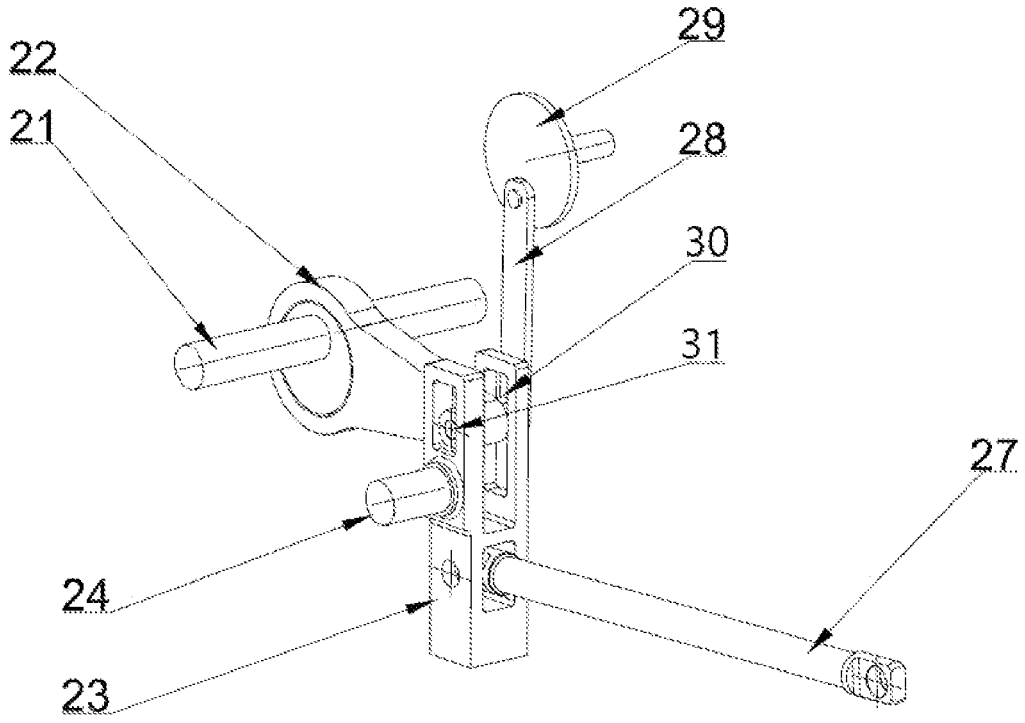

[Fig. 3B]
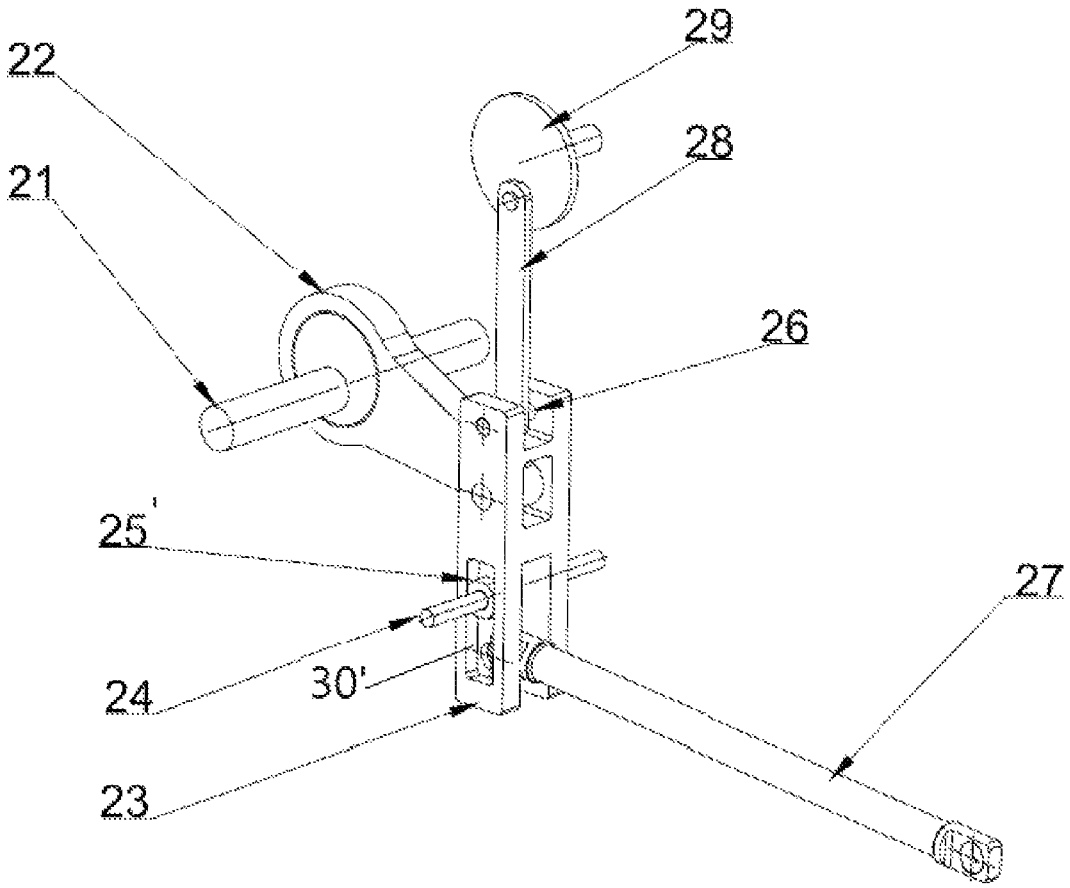

[Fig. 4A]
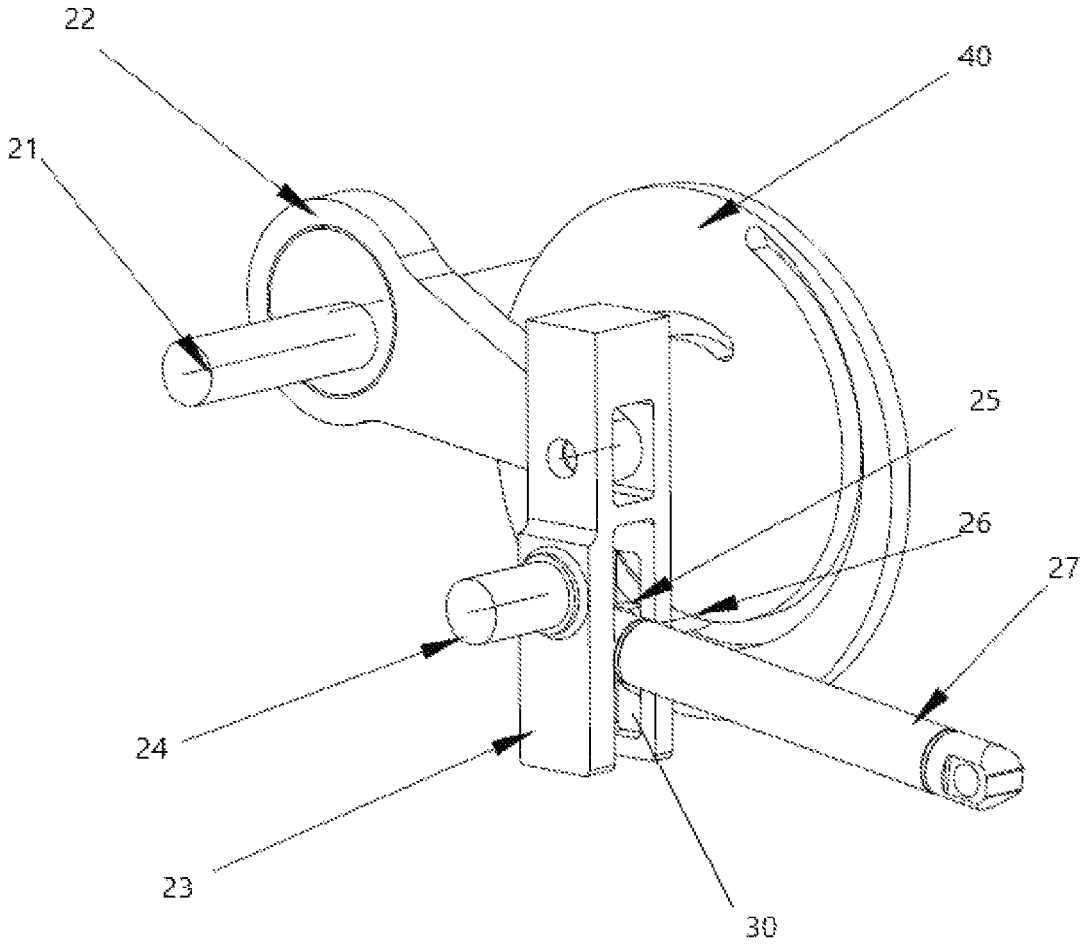

[Fig. 4B]
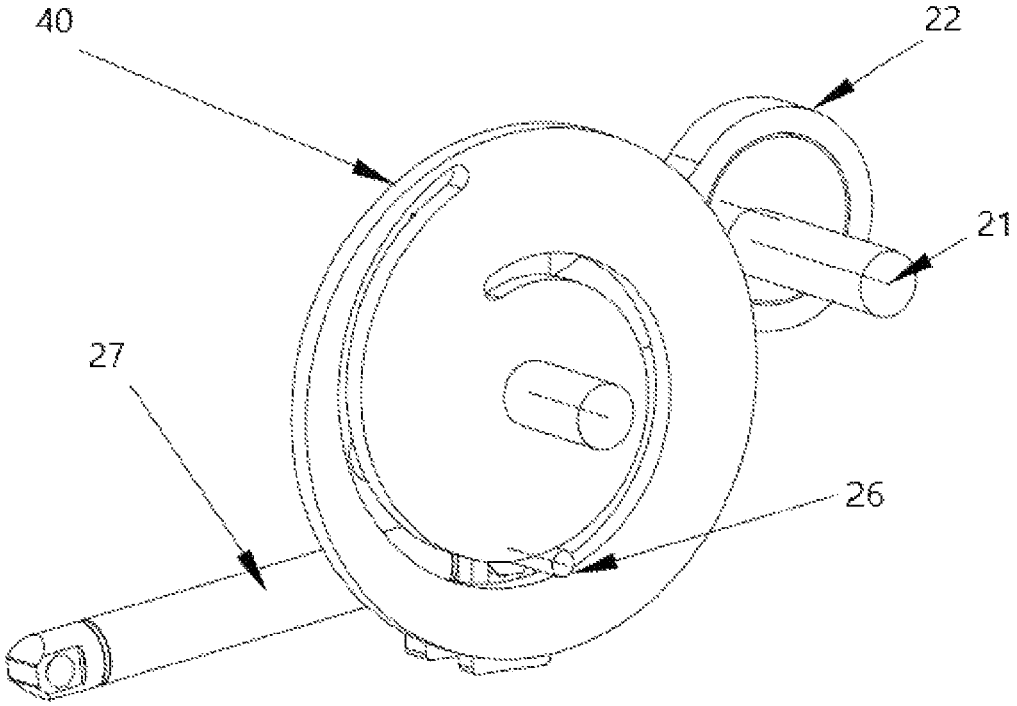

[Fig. 5]
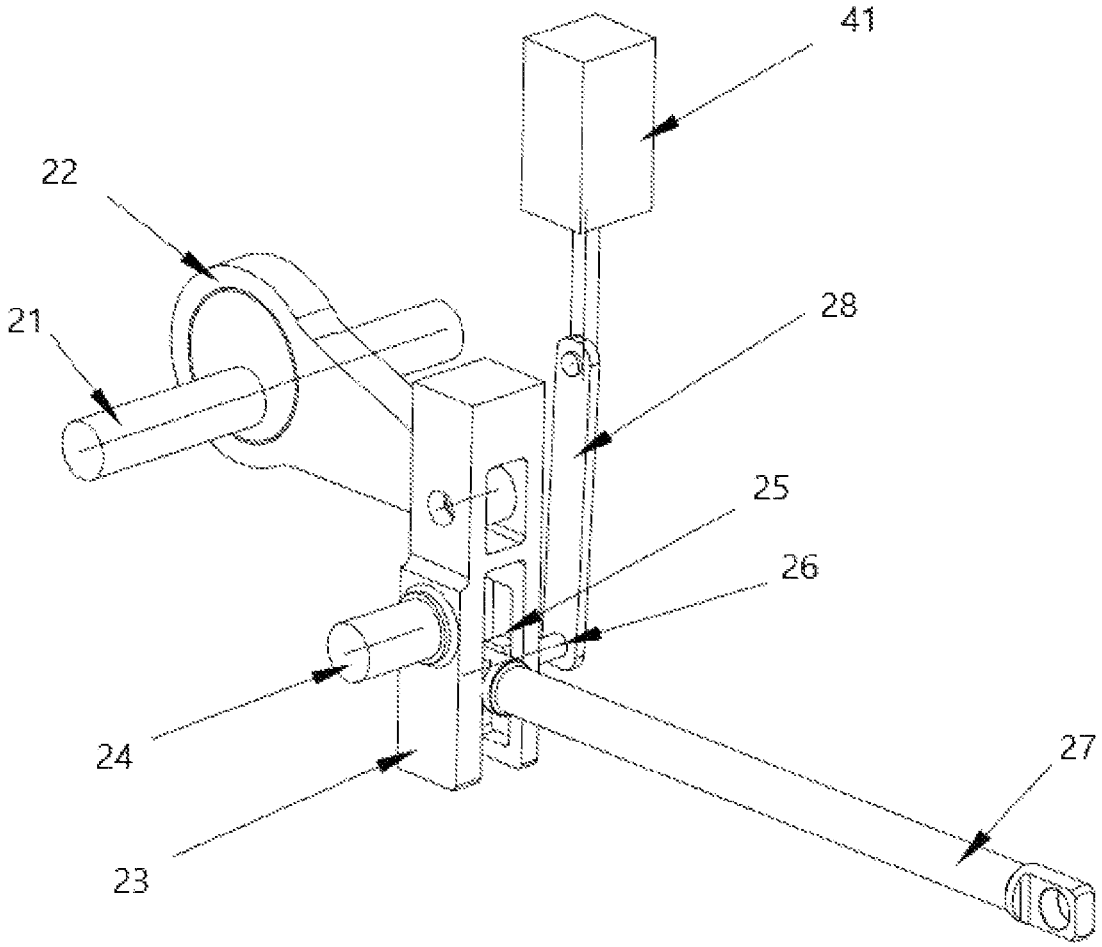

ELLIPTICAL NEEDLELOOM HAVING A SEALED CASING AND A THROUGH GUIDING POT

TECHNICAL FIELD

The present invention refers to a needling machine to consolidate a fleece or web fibres, in particular non-woven by needling, comprising at least one needle plate, over which the fleece or web of fibres passes by moving in the direction of advance or the machine or MD direction, and drive systems configured to impart to the at least one needle plate and or needles a to and fro motion in a direction perpendicular or essentially perpendicular to the plane of the mat or fabric so that the needles cross the fleece or web of fibres in an elliptical path first in one direction then the other.

BACKGROUND

A needling machine of this type is known, for example from EP 1 736 586 in the name of the applicant. The needle plate is rigidly connected to a rod or column that extends in a housing in the longitudinal axis and passes through the wall of the housing through a guide pot in which it slides, with a motion both vertical and in the direction MD thereby imparting to the needles an elliptical motion, the pot being fitted so that it can pivot around a shaft extending in the direction CD (that is perpendicular to both the vertical and the direction MD).

This needling machine of the prior art has the advantage of being able to be largely enclosed, that is the greater part of the column and the drive system for the column, in a sealed housing enabling lubrication of the various mechanical parts and joints to ensure long life and greater reliability of the installation.

This needling machine however has the problem of being a complex structure, requiring in particular, complicated methods, firstly to achieve phase shifting between the two cam shafts that drive the column with an elliptical motion and secondly to maintain oil-tightness between the oscillating pot and the housing.

A needling machine which has the same advantage of being able to be enclosed in a sealed housing to ensure good lubrication of the various drive parts for the column, while however being more compact and less complex, and that also has improved reliability, and in particular is less susceptible to unexpected locking during operation would be desirable.

SUMMARY OF THE INVENTION

According to the invention, a needling machine is as described in claim 1, improvements and beneficial methods of implementation being defined in the claims below.

According to the invention, a less complex system than those of the prior art, in particular from a mechanical point of view which is also more compact is thus obtained. In particular, it is no longer necessary to provide phase shifting of the two cam shafts. At the same time, the ability to rigidly connect a large part of the drive system and the at least one column in a sealed housing providing lubrication for the various mechanical parts to ensure long life and reliability of the installation is preserved. In addition, the drive system according to the invention has the additional advantage that the needles are always oriented to the vertical during their elliptical motion, thus reducing the risk of unexpected jamming of the needling machine.

According to a preferred method of implementation of the invention, the first drive systems comprise two rod-cam shaft systems.

According to a favoured method of implementation, the machine comprises two columns and two guide pots and the first drive systems comprise two rod-cam shaft systems, the heads of the rods being hinged to the respective cam shafts and the feet of the rods each being hinged to a respective column, the cam shafts rotating at the same speed in opposite directions.

According to another favoured method of implementation, the machine comprises one column and one guide pot and the first drive system comprises two rod-cam shaft systems, the cam shafts rotating at the same speed, in opposite directions, the heads of the rods being hinged to the respective cam shafts and the feet of the rods each being hinged to a T-shaped tie rod, the column being hinged to the intermediate rod of the T.

According to a favoured method of implementation, the transverse drive system comprises a control system, itself comprising an invention independent of the invention described above, but which can be combined with it, and which comprises: a drive tie-rod that can be coupled to the needles and/or needle plate and/or to a part connected rigidly to the plate or needles to impart a to and fro motion to them in a direction essentially parallel to the direction MD or parallel to the direction MD, a cam shaft and a rod, the cam shaft driving the rod round a rotation shaft, which in particular extends in the direction CD perpendicular to the direction MD and to the vertical, the rod being linked to the tie-rod by a part forming an intermediate lever pivoting around a pivot shaft, in particular parallel to the rotation axis of the cam shaft, the lever being hinged firstly to the rod, in particular on an axis parallel to the pivot pin and at a distance from it, and secondly to the drive tie-rod, in particular at a point distant from the pivot pin, to impart the to and fro motion to it in the direction MD.

Preferably, the control machine comprises means for adjusting the to and fro stroke of the drive tie-rod.

In particular, the adjustment system adjusts the distance between the pivot pin (24) of the lever (23) and the drive tie-rod (27) and/or the distance between the pivot pin (24) of the lever (23) and the rod (22).

According to a preferred method of implementation, the adjustment system comprises a slider connected rigidly to the drive tie-rod or the pivot pin or hinge pin of the lever rod, the slider and the lever being arranged to enable the slider to slide in relation to the lever between several positions, and means of fixing to lock the slider rigidly to the lever in each of the said several positions.

According to a highly favoured method of implementation, the adjustment comprises a guide slot in which the slider can slide between two end positions, in particular a high position in which the drive tie-rod is level with the pivot pin and a low position in which the drive tie-rod is as far as possible from the pivot pin, thus permitting, depending on the position in the slot in which the slider is positively connected to the lever, adjustment of the amplitude of the to and fro motion of the tie-rod, in particular between zero amplitude (tie-rod not moving) and maximum amplitude.

According to a preferred method of implementation, the means for locking the position of the slider in the slot comprises an adjusting rod linked to an adjusting tie-rod, the adjusting tie-rod being hinged to an auxiliary adjustment cam shaft, the rotation of the auxiliary adjustment shaft enabling adjustment and locking of the position of the slider in the slot.

According to another favoured method of implementation, the means of locking the position of the slider in the slot comprise an adjusting rod positively connected to a spiral cam comprising a disk driven by an auxiliary adjustment shaft in which a spiral slot is cut along which the adjusting rod can be moved.

According to yet another favoured variant, the means of locking the position of the slider in the slot comprises an adjusting rod linked to an adjustment tie-rod driven by an actuator, permitting linear movement of the adjusting tie-rod, the adjusting tie-rod can pivot in relation to the pin of the adjustment rod.

BRIEF DESCRIPTION OF THE DRAWINGS

As an example, preferred methods of implementation of the invention are now described with reference to the drawings in which:

FIG. 1 is a front view of the assembly, partially in cross section, of a needling machine according to a method of implementation of the invention;

FIG. 2 a front view of the assembly, partially in cross section, of a needling machine according to another method of implementation of the invention;

FIG. 3 is a perspective assembly view of the drive or control system of the auxiliary tie-rod;

FIG. 3A is a perspective assembly view of another method of implementation of a control system according to the invention;

FIG. 3B is a perspective assembly view of yet another method of implementation of a control system according to the invention;

FIG. 4A is an assembly view of a variant of the system in FIG. 3;

FIG. 4B is a rear view of the variant in FIG. 4A; and

FIG. 5 is an assembly view of yet another variant of the system in FIGS. 3, 4A and 4B.

DETAILED DESCRIPTION OF THE INVENTION

FIG. 1 shows a method of implementation of a needling machine according to the invention. The housing is shown in cross section, while the rest of the needling machine is shown from the front.

This needling machine comprises two needle plates 10 comprising needles 1 projecting from the lower face of their respective plate arranged either in rows and columns, or randomly, or pseudo-randomly, as is well known in the field. Each needle plate 10 is carried by a beam 2, called the moving beam. The beam 2 and respective plate 10 are connected together but removable so that, when the needles are worn and/or broken, they can easily be replaced with a new plate. The needles are designed to have a to and fro elliptical motion from top to bottom and bottom to top to cross in one direction, then the other, a fleece or web of fibres passing in front of it in the drive or MD direction, that is from to left horizontally in the diagram.

Two longitudinal columns 3 extending along a longitudinal, vertical axis 11 perpendicular to the plane of the plate are each linked to a respective moving beam 2 by means of the two respective intermediate vertical tie-rods 9.

Each vertical tie-rod 9 is hinged, firstly, at its upper end to the lower end of a respective column 3 and, secondly, at its lower end to a point 17 on the upper part of a respective moving beam 2.

First longitudinal drive systems are provided to impart a straight to and fro motion to each column 3 parallel to the longitudinal axis 11, which remains vertical throughout the motion.

A sealed housing 7 encloses the first drive system and part of each column 3, the latter passing through the wall of the housing 7 and through the respective guide pots 4. Each guide pot 4 is fixed in relation to the housing. During its vertical to and fro motion, each column 3 slides inside the respective guide pot 4. Guide bushes 18 are fitted to the inner wall of the guide pots 4 to ensure sliding and lubrication between each column 3 and the respective guide pot 4. Sealing between the column 3 and the guide pot 4 is ensured by a lip seal (not shown) fixed to the base of the guide pot.

The first longitudinal drive system consists of two cam shaft systems 6, whose shafts drive the heads of two rods rotating at the same speed but in opposite directions. The feet of the two rods are hinged to a respective column.

The first longitudinal vertical longitudinal drive system imparts to each column 3 a to and fro motion only in the longitudinal vertical axis.

In addition, second transverse drive systems in the form of a main tie-rod 8 are fitted in the direction MD. One end of the tie-rod 8 is hinged at the hinge point 17 of the upper part of one of the moving beams 2 to the vertical tie-rod. In this way, a to and fro motion in the direction MD, or essentially in the direction MD is imparted to this moving beam 2 (as shown by the double arrow above the tie-rod 8 in FIG. 1). The other end of the tie-rod 8 is coupled to a control system, called the advance system, which can, in particular, be like those below in FIGS. 3 to 5. In addition, an auxiliary tie-rod 20 is hinged firstly at the end of the main tie-rod 8, in particular at point 17 of the moving beam 2, and secondly to the moving part, thus also imparting to the latter a to and fro motion in the direction MD.

FIG. 2 shows another method of implementation of a needling machine according to the invention. The housing is shown in cross section, while the rest of the needling machine is shown from the front.

This needling machine comprises a needle plate 10' comprising needles 1' projecting from the lower face of their respective plate and arranged either in rows and columns, or randomly, or pseudo-randomly, as is well known in the field. The needle plate 10' is carried by a beam 2', called the moving beam. The beam 2' and plate 10' are linked together, but removable to enable a plate to be easily replaced with a new plate when the needles are worn and/or broken. The needles are designed to have an elliptical to and fro motion from top to bottom and from bottom to top in order to pass over, first in one direction then the other, a fleece or web of fibres passing in front of it in the drive or MD direction, that is from left to right horizontally in the diagram.

A longitudinal column 3', extending in a vertical, longitudinal axis 11' perpendicular to the plane of the plate, is linked to the moving beam 2' with an intermediate vertical tie-rod 9'.

The vertical tie-rod 9' is hinged, firstly, at its upper end to the lower end of the column 3' and secondly, at its lower end to a point 17 on the upper part of the moving beam 2'.

First longitudinal drive systems are fitted to impart a straight to and fro motion to the column 3' parallel to the longitudinal axis 11', which remains vertical throughout the motion.

A sealed housing 7' encloses the first drive systems and part of the column 3', the latter passing through the wall of the housing 7' through its respective guide pot 4'. The guide pot 4' is fixed to the housing. The column 3', slides inside the guide pot 4' during its to and fro vertical motion. Guide bushes 18 are fitted in the wall inside the guide pot 4' to provide sliding and lubrication between the column 3' and the guide pot 4'. Oil-tightness between the column 3' and the guide pot 4' is ensured by a lip seal (not shown) fixed to the base of the guide pot.

The first longitudinal drive system consists of two cam shaft systems 6', whose shafts drive the heads of two rods turning at the same speed in opposite directions. The feet of the two rods are hinged to their respective lateral branches of a T-shaped tie-rod 19, while the main stem or branch of the T-shaped tie-rod is hinged to the column 3'. The first vertical longitudinal drive systems impart to the column 3' a solely to and fro motion in the longitudinal vertical axis.

Second transverse drive systems are also fitted in the form of a main tie-rod 8' running in the direction MD. One end of the tie-rod 8' is hinged to the vertical tie-rod at the hinge point 17' on the upper part of the moving beam 2'. A to and fro motion in the direction MD, or essentially in the direction MD (as shown by the double arrow above the tie-rod 8' in FIG. 2) is also imparted to the moving beam 2'. The other end of the tie-rod 8' is coupled to a control system called the advance system, which in particular can be like those shown below in FIGS. 3 to 5.

FIGS. 3, 3A, 3B, 4A, 4B and 5, show methods of implementation of a system that can be used to control the to and fro movement of the main tie-rod 8 in the MD direction in the method of implementation in FIG. 1. However, this control system is not necessary per se and other control systems for the to and fro movement in the direction MD of the tie-rod 8 known in the prior art can be used, for example, systems such as those described in EP-A1-1736586, EP-B1-3372716, FR2738846, U.S. Pat. No. 6,161,269 and the like.

In FIG. 3, the system comprises a cam shaft 21 coupled to a rod 22 that is hinged directly to a one-part vertical lever 23 (or possibly several parts not hinged to each other) that pivot in relation to an offset pivot pin 24, in the vertical direction, below the hinge pin of the rod 22 to the lever 23. A tie-rod 27 is coupled directly to the lever 23. The tie-rod 27 is rigidly coupled to a slider 25 and one end of a rod 26 whose axis is parallel to the pin 24.

The relative position of the rod 26, and therefore also of the tie-rod 27, in relation to the pivot pin 24 of the lever in the vertical direction and/or in relation to the hinger pin of the rod 22 to the lever can be adjusted by means of an adjustment system consisting of an auxiliary adjustment cam shaft 29 and an adjustment tie-rod 28. The adjustment tie-rod 28 is hinged at its upper end to the cam shaft (or crankshaft) 29, while its lower end pivots in relation to the pin of the rod 26.

The lever includes an opening in the form of a slot 30, along which the slider slides 25 rigidly with the rod 26 in translation.

Depending on the position of the tie-rod 28 which is determined by appropriate rotation of the crankshaft 29, the relative position of the slider 25 in the slot 30 can be chosen and adjusted to adjust the distance along the vertical axis of the lever between pin 24 and the axis of the rod 26 (and therefore also the distance between the axis of the rod 26 and the axis of the rod 22), this distance can be varied between zero (the position in which the slider 25 is at the top of the slot 30) so that the axis of the rod 26 corresponds with the pin 24 at the position of maximum adjustment (where the slider 25 is at the bottom of the slot 30).

The amplitude of the to and fro motion of the tie-rod 27 can be varied either while running or at rest, the motion repeats the motion of the crankshaft 21 and the tie-rod 22 acting on the lever 23. Regarding the tie-rod 27, this can be fixed rigidly or hinged to the main tie-rod in the method of implementation shown in FIGS. 1 and 2.

FIG. 3A shows a variant of the arrangement in FIG. 3. In this variant, the distance between the rod 22 and the drive tie-rod 27 can be adjusted by the position along the slot 30 of the hinge pin 31 of the rod 22 to the lever 23, which enables the distance between the hinge pin 31 of the rod 22 and the fixed pivot pin 24 of the lever to be adjusted, which also adjusts the distance between the pin 31 and the tie-rod 27, the distance between the tie-rod and the pin 24 being locked in this variant, while in the method of implementation in FIG. 3, it is the distance between the pin 31 and the pin 24 that is locked.

FIG. 3B shows a variant of the arrangement in FIG. 3. In this variant, the distance between the rod 22 and the drive tie-rod 27 is adjusted by adjusting the position along a slot 30' formed in the lever 23 of the fixed pivot pin 24 of the lever. The pin 24 of the lever is connected rigidly to a slider 25' which slides in the slot 30'. The rod 22 is hinged to the lever 23 with a hinge pin 31 which is in a fixed position on the lever 23. The hinge end of the tie-rod 27 to the lever 23 is in a fixed position (as in the method of implementation in FIG. 3). In the same way, the rod 26 projecting from the adjustment tie-rod 28 is hinged to the lever 23 at a fixed position. By means of the tie-rod 28 the relative position of the pin 24 in relation to the lever 23 can therefore be adjusted and thus the relative position of the tie-rod 27 in relation to the pin 24 and the relative position of the rod 22 in relation to the pin 24, thereby adjusting the to and fro stroke of the tie-rod 27, the distance between the tie-rod 27 and the rod 22 being fixed in this variant.

FIGS. 4A and 4B show another method of implementation. The main difference between the method of implementation in FIG. 3 and those in FIGS. 4A and 4B is the manner in which the position of the slider 25 is adjusted in relation to the slot 30.

In this method of implementation, a spiral cam is used, consisting of a disk 40 containing a spiral slot along which the pin 26 can be moved. As the disk 40 rotates, the pin 26 follows the profile of the slot 30, which has the effect of moving the pin 26 and therefore the slider 25 along the slot. Depending on the position chosen for the pin 26 along the spiral, a given maximum to and fro stroke for the tie-rod 27 is obtained.

FIG. 5 shows yet another method of implementation in which a ram 41 is used instead of the crankshaft 29 in FIG. 3, the rest of the method of implementation is the same.

In the methods of implementation described in FIGS. 4A, 4B and 5, instead of the arrangement described here, in which it is the distance between the pin 24 and the tie-rod 27 that is adjusted (as in the variant in FIG. 3), arrangements as in the variants in FIGS. 3A and 3B could be used.

In the present description, first drive systems using two cam shaft systems to produce a purely longitudinal motion of the column are described. Other methods could be considered, for example a ram or cam shaft system.

The invention claimed is:

1. A needling machine to consolidate a fleece or web of fibres by needling, comprising:

one or more needle plates having a respective array of needles;

one or more columns with a respective longitudinal axis coupled to the needle plate or one respective needle plate;

driving means configured to impart a to and fro motion to each of the one or more needle plates so that the needles have an elliptical path that passes first in one direction, then the other, through the fleece or web of fibres that is moved in front of said needles in a machine or drive MD direction to consolidate said fleece or web of fibres;

a sealed housing in which is contained a part of each of the one or more columns and a part of the driving means; and one or more guide pots fitted in a respective opening of the sealed housing, each of the one or more columns passing through the housing through a respective guide pot by sliding, characterised in that, the driving means comprise longitudinal driving means configured to impart to the or each column a straight to and fro motion in a direction parallel to the longitudinal axis;

each of the one or more needle plates pivots in relation to its respective column; and the driving means comprise transverse driving means configured to impart to a point on each of the one or more needle plates or to a part rigidly connected to each of the one or more needle plates, a to and fro motion in a direction parallel to the MD direction.

2. The needling machine according to claim 1, characterised in that the transverse driving means comprise a main tie-rod firstly hinged to one of the one or more needle plates and secondly coupled to a control system for controlling the to and fro motion in a direction parallel to the MD direction.

3. The needling machine according to claim 2, characterised in that said needling machine comprises a plurality of columns and a plurality of needle plates, and there is provided one or more auxiliary tie-rods hinged between two respective needle plates, or to parts rigidly connected to the two respective needle plates.

4. The needling machine according to claim 3, characterised in that a hinge point of the main tie rod to a first needle plate or to a part rigidly connected to the first needle plate and a hinge point of the auxiliary tie-rod to the first needle plate or to the part rigidly connected to the first needle plate are identical.

5. The needling machine according to claim 1, characterised in that the pivoting of each of the one or more needle plates in relation to each of the one or more columns is achieved by an intermediate respective tie-rod interposed between each column and each needle plate.

6. The needling machine according to claim 5, characterised in that each intermediate tie-rod is hinged at an upper end thereof to a respective column of the one or more columns and at a lower end thereof to a respective needle plate of the one or more needle plates or to a part rigidly connected to the respective needle plate of the one or more needle plates.

7. The needling machine according to claim 1, characterised in that each guide pot of the one or more guide pots is fixed in relation to the housing.

8. The needling machine according to claim 1, characterised in that the longitudinal driving means are enclosed in the sealed housing and the transverse driving means are outside the housing.

9. The needling machine of claim 1, wherein the fleece or web of fibres is a non-woven fleece or web of fibres.

10. The needling machine of claim 1, wherein the respective longitudinal axis is a longitudinal vertical axis.

* * * * *